US007781949B2

(12) United States Patent
Kishimoto et al.

(10) Patent No.: US 7,781,949 B2
(45) Date of Patent: Aug. 24, 2010

(54) SPARK PLUG

(75) Inventors: Kaori Kishimoto, Aichi (JP); Katsutoshi Nakayama, Aichi (JP); Hiroyuki Kameda, Aichi (JP); Yasushi Sakakura, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 483 days.

(21) Appl. No.: 11/941,304

(22) Filed: Nov. 16, 2007

(65) Prior Publication Data

US 2008/0122334 A1 May 29, 2008

(30) Foreign Application Priority Data

Nov. 23, 2006 (JP) ..... 2006-316376

(51) Int. Cl.
*H01T 13/20* (2006.01)

(52) U.S. Cl. ..... 313/143; 313/141; 123/169 R; 123/169 EL

(58) Field of Classification Search ..... 313/141, 313/143; 123/169 R, 169 EL; 445/7
See application file for complete search history.

(56) References Cited

U.S. PATENT DOCUMENTS

| | | | | |
|---|---|---|---|---|
| 5,797,383 | A | 8/1998 | Matsubara et al. | 123/594 |
| 6,281,682 | B1 | 8/2001 | Kameda et al. | 324/391 |
| 6,371,078 | B1 | 4/2002 | Kondo et al. | 123/305 |
| 6,505,605 | B2 | 1/2003 | Yamada et al. | 123/406.14 |
| 6,512,375 | B1 | 1/2003 | Yamada et al. | 324/399 |
| 6,564,786 | B2 | 5/2003 | Kameda et al. | 123/606 |
| 6,628,050 | B1 | 9/2003 | Kameda et al. | 313/143 |
| 6,715,340 | B2 | 4/2004 | Yamada et al. | 73/35.08 |
| 6,779,517 | B2 | 8/2004 | Sakakura | 123/630 |

FOREIGN PATENT DOCUMENTS

| | | |
|---|---|---|
| JP | 4-366581 | 12/1992 |
| JP | 5-101869 | 4/1993 |
| JP | 2001-351761 | 12/2001 |
| JP | 2005135783 | 5/2005 |
| WO | WO 2005/099343 | 10/2005 |

*Primary Examiner*—Nimeshkumar D. Patel
*Assistant Examiner*—Mary Ellen Bowman
(74) *Attorney, Agent, or Firm*—Kusner & Jaffe

(57) ABSTRACT

A spark plug including a ground electrode which has an excellent heat sinking ability. The ground electrode includes a core material therein. Heat received from a combustion chamber during a drive of an internal-combustion engine can be conducted to the core material. More effective heat sinking ability can be achieved because of the core material.

6 Claims, 10 Drawing Sheets

SPARK PLUG

FIELD OF THE INVENTION

The present invention relates to a spark plug used for internal-combustion engines and including a ground electrode which has a metal-made core material excellent in thermal conductivity.

BACKGROUND OF THE INVENTION

Conventionally, a spark plug is used for igniting an internal-combustion engine. An ordinary spark plug is comprised of: a metal shell radially surrounding and holding a circumference of an insulator in which a center electrode is accommodated in an axial bore; and a ground electrode in which one end thereof is joined to a front end of the metal shell and the other end thereof is bent towards a front end of the center electrode so as to face each other and form a spark discharge gap therebetween. Such a spark plug tends to be exposed at a high temperature because the ground electrode projects to a combustion chamber when the spark plug is attached to an engine head. Thus, since the heat load applied to the ground electrode becomes greater, an improvement in heat sinking ability (thermal conductivity) of the ground electrode has become highly demanded.

Japanese Patent Application Laid-Open (kokai) No. 2005-135783 discloses a ground electrode comprised of an electrode base material (e.g., nickel base alloy or the like) having corrosion resistance and oxidation resistance. A core material (e.g., Cu, Ag or the like) having an excellent thermal conductivity is embedded in the electrode base to promptly conduct heat generated during the engine drive to a metal shell. Generally, such a ground electrode is formed through an extrusion molding process to produce an integrated body where a cup-like electrode base material accommodates the core material therein. The thus-produced ground electrode is joined to the metal shell at a rear end portion thereof where a front end side in the extruding direction serves as a front end portion and a rear end side serves as the rear end portion. In the electrode base material, the core material is disposed so as to taper towards the front end side of the ground electrode.

However, since the power of an internal-combustion engine has been recently stronger, the heat load applied to a ground electrode has been greater in connection with a fuel combustion temperature in a combustion chamber. When a core material assumes a tapered shape towards a front end side of the ground electrode as mentioned above, the core material is disposed in a vicinity of an axis line and not near an outer circumference face in the front end portion of the ground electrode. Thus, heat that the front end portion of the ground electrode receives is unlikely to be promptly conducted to the metal shell, and the heat sinking ability of the ground electrode tends to be insufficient.

The present invention has been developed in view of the above problems, and provides a spark plug including a ground electrode which has an excellent heat sinking ability.

SUMMARY OF THE INVENTION

In order to solve the above problems, there is provided a spark plug according to a first embodiment, comprising: a center electrode; an insulator having an axial bore that extends along an axial direction of the center electrode and that accommodates the center electrode therein; a metal shell surrounding the insulator in a radial direction so as to hold the insulator therein; and a ground electrode having one end bonded to the metal shell and the other end bent so that a side face of the ground electrode is located opposed to the center electrode, and accommodating a core material which extends from one end to the other end of the ground electrode along a first direction, wherein, when an outline of the core material is defined by projecting the core material onto the side face of the other end of the ground electrode, at least either a second part located on a first segment side in a second direction and close to the edge of the other end of the ground electrode or a third part located on a second segment side in the second direction and close to the edge of the other end of the ground electrode is disposed on a side towards the edge of the other end of the ground electrode with respect to a first part located in a center with respect to the second direction, which is perpendicular to the first direction, on a third segment that connects the first segment and the second segment at the edge of the other end both of which constitute the outline of the core material and extend along the first direction.

In addition to the composition of the present invention according to the first embodiment, there is provided a spark plug according to a second embodiment, wherein an electrode tip is bonded to the side face of the other end of the ground electrode.

In addition to the composition of the present invention according to the second embodiment, there is provided a spark plug according to a third embodiment, wherein the electrode tip is bonded to the side face of the ground electrode through resistance welding, and wherein, when the outline of the core material and that of a bonding face of the electrode tip bonded to the side face are defined by projecting the core material and the bonding face, respectively, onto the side face of the other end of the ground electrode, a fourth part located in a furthest position away from the edge of the other end of the ground electrode on the outline of the bonding face of the electrode tip is disposed between the first part located on the outline of the core material defined by projecting the core material onto the side face and at least either the second part or the third part in the first direction.

In addition to the composition of the invention according to the third embodiment, there is provided a spark plug according to a fourth embodiment, wherein, when the outline of the core material and that of the bonding face of the electrode tip bonded to the side face are projected, respectively, onto the side face of the other end of the ground electrode, the outline of the bonding face of the electrode tip and that of the core material are kept in a noncontact state.

In addition to the composition of the invention according to any one of embodiments from second to fourth, there is provided a spark plug according to a fifth embodiment, comprising the columnar shape electrode tip with an outer diameter of 2 mm or more, wherein, when the outline of the core material and that of the bonding face of the electrode tip bonded to the side face are defined by projecting the core material and the bonding face, respectively, onto the side face of the other end of the ground electrode, at least either a representation of $W2>R$ or $W3>R$ is satisfied, where a position of the central axis of the electrode tip is regarded as a location C, a radius of the electrode tip is regarded as R, a distance between the position of second part and the location C in the second direction is regarded as W2, and a distance between the position of the third part and the location C in the second direction is regarded as W3.

In addition to the composition of the invention according to any one of embodiments from second to fifth, there is provided a spark plug according to a sixth embodiment, comprising the columnar shape electrode tip with an outer diameter of 2 mm or more, wherein, when the outline of the core material and that of the bonding face of the electrode tip bonded to the side face are projected, respectively, onto the side face of the other end of the ground electrode, at least either a representation of L2<L1 or L3<L1 is satisfied as is R<L1, where a position of the central axis of the electrode tip is regarded as a location C, a radius of the electrode tip is regarded as R, a distance between the position of first part and the location C in the first direction is regarded as L1, a distance between the position of second part and the location C in the first direction is regarded as L2, and a distance between the position of the third part and the location C in the first direction is regarded as L3.

In the spark plug according the first embodiment, since at least either the second part or the third part is disposed on a side towards the edge of the other end of the ground electrode with respect to the first part on the third segment that constitutes the outline of the core material defined by projecting the core material onto the side face of the ground electrode, the core material can be located on the further edge side of the front end portion and close to the outer circumference face. With this composition, in the front end portion of the ground electrode, heat received from a combustion chamber during a drive of an internal-combustion engine can be conducted to the core material from the position on the further front end side and close to the outer circumference face. As a result, more effective heat sinking ability of the front end portion of the ground electrode can be achieved.

The composition that the core material can be located on the further edge side of the front end portion and close to the outer circumference face is still effective for the case where an electrode tip for improving a durability of an electrode in a spark discharge gap is provided in the front end portion of the ground electrode according to the second embodiment. As mentioned above, in addition to the improvement in the heat sinking ability of the front end portion of the ground electrode, heat that the electrode tip receives can be smoothly conducted to the core material. As a result, the heat sinking ability near the spark discharge gap can be further improved.

When such an electrode tip is bonded to the front end portion of the ground electrode through the resistance welding, heat produced in a welding area at the time of bonding is conducted through the core material whereby it is unlikely to obtain sufficient bonding strength. In this case, as in the present invention according to the third embodiment, the fourth part on the outline of the bonding face of the electrode tip which is defined by projecting the bonding face onto the side face of the ground electrode is located between the first part on the outline of the core material and at least either the second part or the third part in the first direction. With this composition, a portion can be reliably provided where the outline of the electrode tip and that of the core material defined by projecting the electrode tip and the core material, respectively, onto the side face of the ground electrode do not overlap each other, thereby preventing heat during the resistance welding from being conducted to the core material. As a result, the electrode tip and the ground electrode can be further effectively bonded together. On the other hand, since at least either the second part or the third part since on the outline of the core material is disposed on the further front end side of the ground electrode with respect to the fourth part on the outline of electrode tip, the core material and the electrode tip are disposed close to each other in the light of the relation between the first part on the outline of the core material and the fourth part on the outline of the electrode tip. Thus, heat that the electrode tip receives can be smoothly conducted to the core material whereby the heat sinking ability near the spark discharge gap can be further improved.

Further, as in the present invention according to the fourth embodiment, when the outline of the bonding face of the electrode tip and that of the core material are kept in the noncontact state, both of which are defined by projecting the bonding face and the core material, respectively, onto the side face of the ground electrode, heat during the resistance welding is more effectively prevented from being conducted to the core material, thereby improving the bonding strength. Furthermore, since the core material can extend towards the further front end side of the front end portion by diverting the position of the electrode tip, the heat that the electrode tip receives can be conducted to the core material whereby the heat sinking ability near the spark discharge gap can be further improved.

As in the present invention according to the fifth embodiment or the sixth embodiment, when a positional relationship between the outline of the bonding face of the electrode tip and that of the core material both of which are defined by projecting the bonding face and the core material, respectively, onto the side face of the ground electrode is more specifically defined, the bonding strength between the electrode tip and the ground electrode can be sufficiently secured as well as improving the heat sinking ability of the front end portion of the ground electrode including heat conduction from the electrode tip to the ground electrode.

DETAILED DESCRIPTION OF PREFERRED EMBODIMENTS

Figure 1:
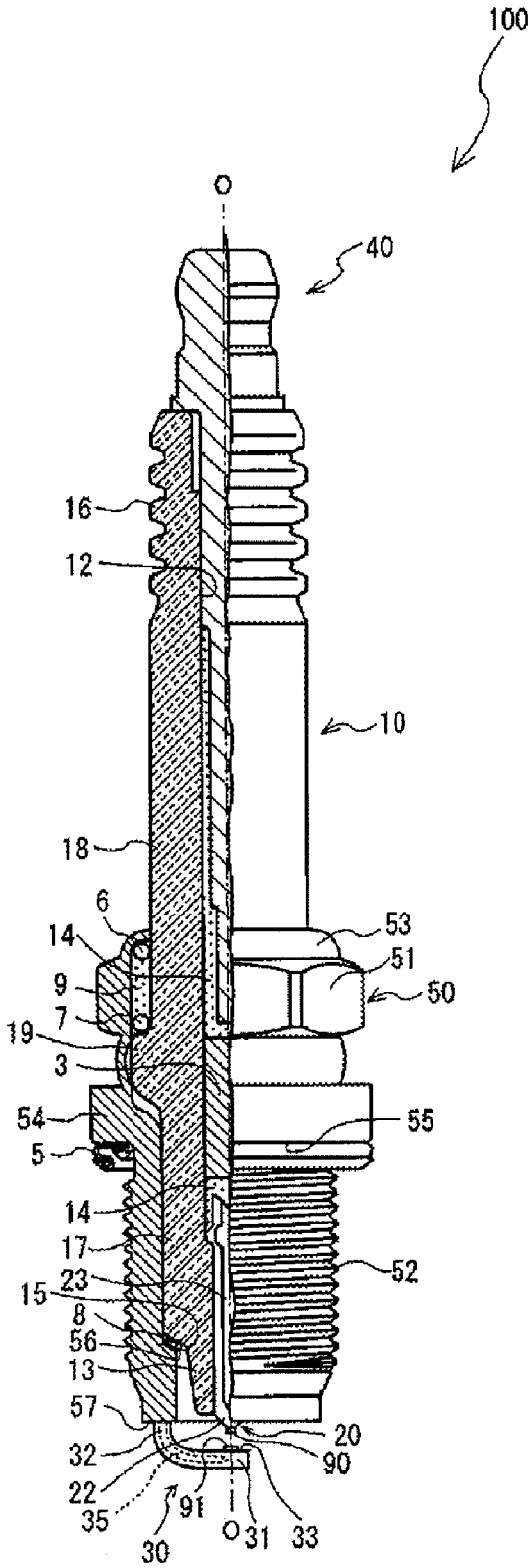
FIG. 1 is a partial sectional view of spark plug 100.

Hereafter, an embodiment of a spark plug embodying the present invention will be described with reference to the drawings. First, referring to FIG. 1, a composition of a spark plug 100 will be explained. FIG. 1 is a partial sectional view of the spark plug 100. It is noted that, in the axial direction "O", a side where a center electrode 20 is accommodated in an axial bore 12 of an insulator 10 is regarded as a front end side of the spark plug 100, and a side where a terminal metal fitting 40 is held is regarded as a rear end side of the spark plug 100 in the specification.

As shown in FIG. 1, the spark plug 100 is comprised of: an insulator 10; a metal shell 50 provided in a generally central portion of the insulator 10 in the longitudinal direction and holding the insulator 10; a center electrode 20 accommodated in an axial bore 12 of the insulator 10 in the axial direction; a ground electrode 30 having one end (a base portion 32) welded to a front end face 57 of the metal shell 50 and the other end (a front end portion 31) bent towards a front end portion 22 of the center electrode 20; and a terminal metal fitting 40 provided at a rear end portion of the center electrode 20.

First, the insulator 10 constituting an insulating body of the spark plug 100 will be described. The insulator 10 is a tubular insulating member including the axial bore 12 in the axial direction "O", which is formed by sintering alumina or the like as is commonly known. A flange portion 19 having the largest outer diameter is formed in a generally center with respect to the axial direction "O", and a rear end side body portion 18 is formed at the rear end side of the flange portion 19. Further, a corrugate portion 16 used for extending a creepage distance is formed in the rear end side of the rear end side body portion 18. A front end side body portion 17 having a smaller outer diameter than that of the rear end side body portion 18 is formed at the front end side of the flange portion 19. A long leg portion 13 having a smaller outer diameter than that of the front end side body portion 17 is formed at further front end side of the front end side body portion 17. The long leg portion 13 tapers off toward the front end side, and the long leg portion 13 is exposed to the combustion chamber when the spark plug 100 is assembled in an internal-combustion engine (not shown).

Next, the center electrode 20 will be explained. The center electrode 20 is a rod-shaped electrode wherein a metal core 23 for facilitating heat sinking and made of Cu, Ag or the like as a elemental substances, or an alloy containing Cu, Ag or the like as a main component is embedded in a center portion of an electrode base material 21 made of nickel-system alloy or the like such as INCONEL (trade name) 600 or 601. A part of the front end portion 22 of the center electrode 20 projects from a front end face of the insulator 10 and tapers off toward the front end side. A columnar electrode tip 90 made of, for example, a noble metal, such as Pt, is welded through resistance welding to a front end face of the front end portion 22 so as to align its column axis with an axis of the center electrode 20. The center electrode 20 is electrically connected to the upper terminal metal fitting 40 through a sealing body 14 and a ceramic resistance 3 provided inside the axial bore 12. A high-tension cable (not shown) is connected to the terminal metal fitting 40 through a plug cap (not shown), to which high voltage is applied.

Next, the metal shell 50 will be described. The metal shell 50 holds the insulator 10 to fix the spark plug 100 to an engine head of the internal-combustion engine (not shown). The metal shell 50 holds the insulator 10 so as to surround the flange portion 19, the front end side body portion 17 and the long leg portion 13 from the rear end side body portion 18 which is close to the flange portion 19 of the insulator 10. The metal shell 50 is comprised of a low-carbon-steel material and includes a tool engagement portion 51 to which a spark plug wrench (not shown) is fit at the rear end side, and a screw portion 52 which screws to an engine head provided at an upper part of the internal-combustion engine (not shown).

Annular ring members 6, 7 are interposed between the tool engagement portion 51 of the metal shell 50 and the rear end side body portion 18 of the insulator 10. Further, talc powder 9 is filled between the ring members 6, 7. A sealing portion 53 is formed at the rear end side of the tool engagement portion 51. The insulator 10 is forced toward the front end side in the metal shell 50 through the ring members 6, 7 and the talc 9 by sealing the sealing portion 53. A step portion 15, formed between the front end side body portion 17 and the long leg portion 13 of the insulator 10, is supported by a step portion 56 formed in the inner periphery of the metal shell 50. A packing 8 is disposed between step portion 15 and step portion 56. As a result, the metal shell 50 and the insulator 10 are integrated. Airtightness between the metal shell 50 and the insulator 10 is maintained by the packing 8, which prevents combustion gas from flowing out from the combustion chamber (not shown) through spark plug 100. A flange portion 54 is formed in the center portion of the metal shell 50, and a gasket 5 is inserted in and fitted to the vicinity of the rear end side of the screw portion 52 (upper portion in FIG. 1)—i.e., fitted to a seat surface 55 of the flange portion 54.

Figure 2:
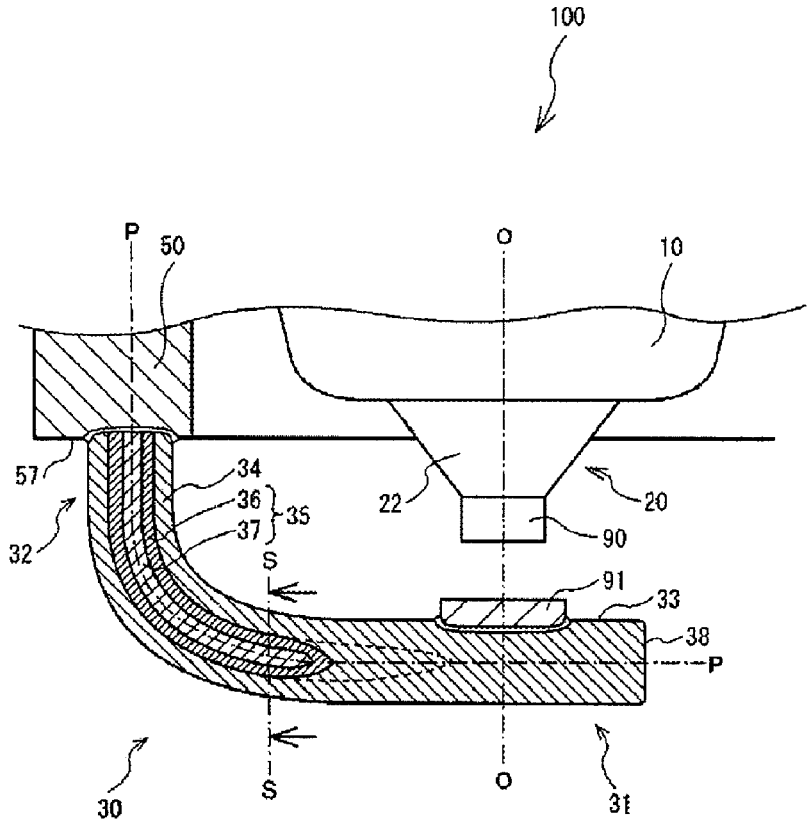
FIG. 2 is an enlarged sectional view showing around the ground electrode 30.
Figure 3:
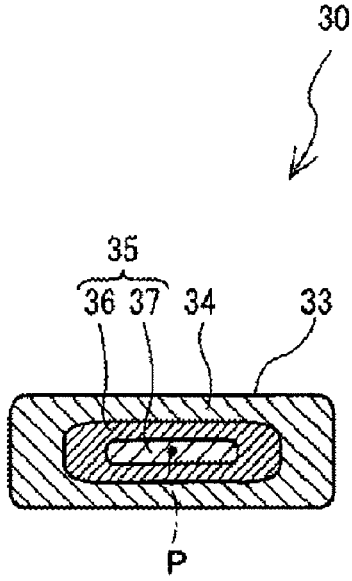
FIG. 3 is a sectional view showing the ground electrode 30 seen from the arrow direction in a two-dot chain line S-S of FIG. 2.
Figure 4:
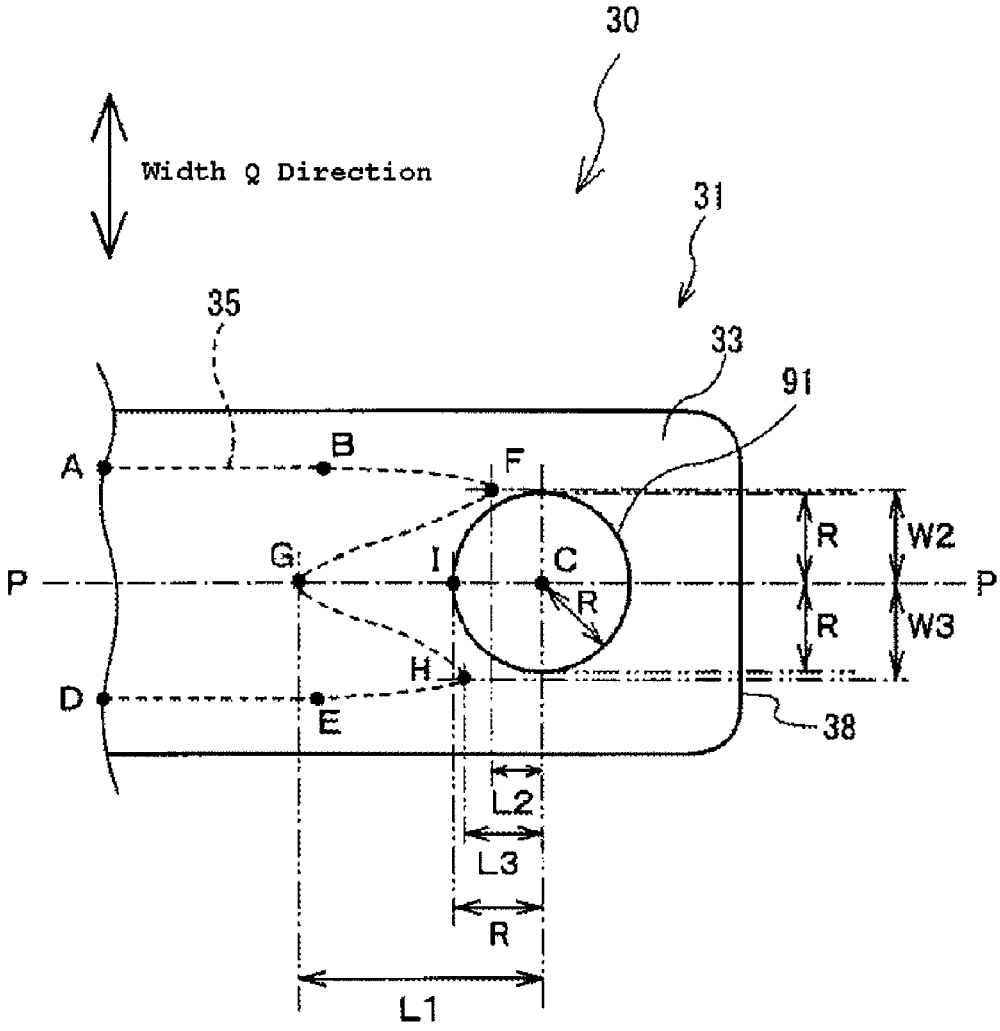
FIG. 4 is a diagram showing a positional relation between an electrode tip 91 and a core material 35 whose outline is defined by projecting the core material 35 onto an inner face 33 of the ground electrode 30 from the thickness direction.
Figure 5:
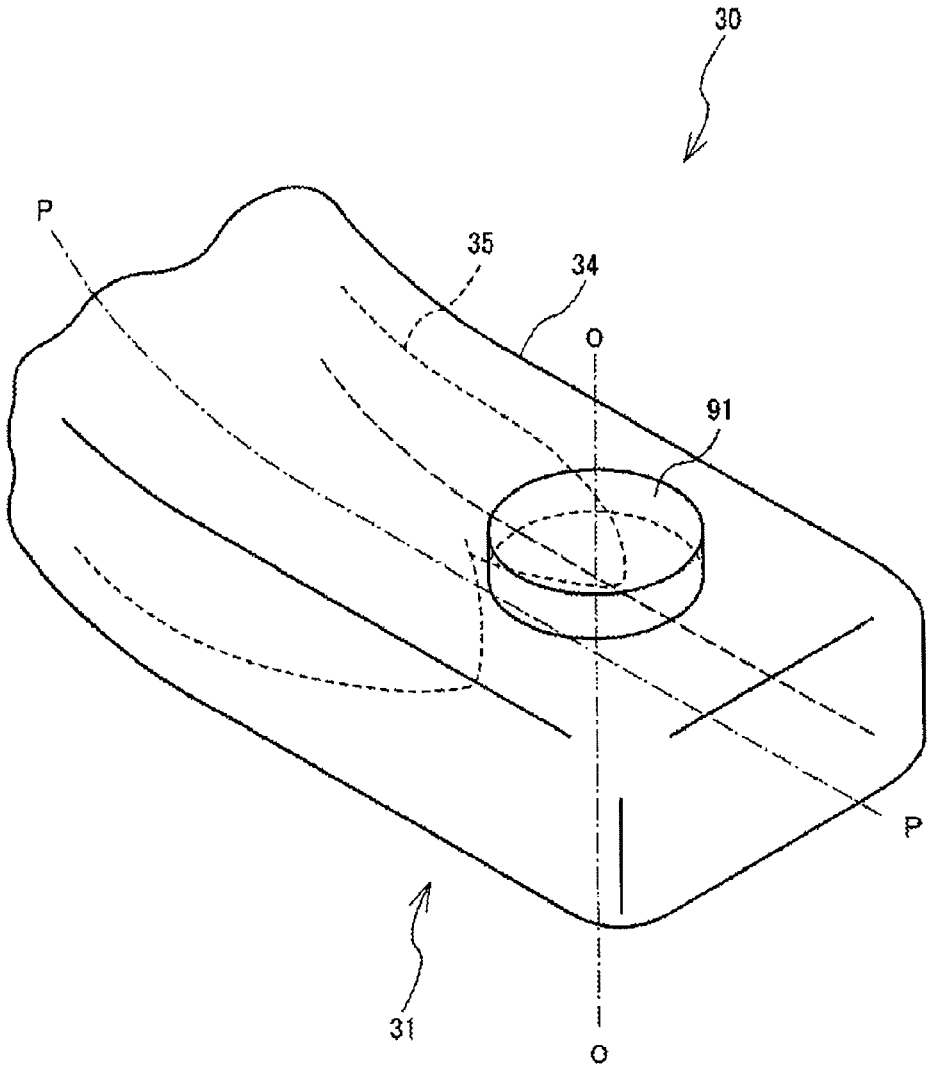
FIG. 5 is a perspective view showing an outline of the core material 35 embedded in a front end portion 31 of the ground electrode 30 so as to show a positional relation between the core material 35 and the electrode tip 91.

Next, the ground electrode 30 will be described with reference to FIGS. 1 to 5. FIG. 1 is a partial sectional view of the spark plug 100. FIG. 2 is an enlarged sectional view showing around the ground electrode 30. FIG. 3 is a sectional view taken along lines S-S of FIG. 2 showing the ground electrode 30. FIG. 4 is a diagram showing a positional relation between an electrode tip 91 and a core material 35 whose outline is defined by projecting the core material 35 onto an inner face 33 of the ground electrode 30 from the thickness direction. FIG. 5 is a perspective view showing an outline of the core material 35 embedded in the front end portion 31 of the ground electrode 30 so as to show a positional relation between the core material 35 and the electrode tip 91.

The ground electrode 30 shown in FIG. 1 generally has the rear end portion 32 joined to the front end face 57 of the metal shell 50. The front end portion 31 of ground electrode 30 is bent so as to face the front end portion 22 of the center electrode 20. The electrode tip 91 made of a noble metal, such as Pt, is bonded to the inner face 33 of the ground electrode 30, which is one of the side faces and is located opposed to the center electrode 20.

The ground electrode 30 shown in FIG. 2 is comprised of: an electrode base material 34 made of a nickel alloy, such as INCONEL (trade name) 600 or 601, and having an excellent corrosion resistance; and the core material 35 for facilitating the heat sinking having a better thermal conductivity than that of the electrode base material 34. As shown in FIG. 3, the ground electrode 30 assumes a generally plate-like rectangular shape in the cross-section perpendicular to its axis line P. As shown in FIG. 2, in the ground electrode 30, one of two wide side faces, identified as the inner face 33, is located so as to be opposed to the center electrode 20. The rear end portion 32 of ground electrode 30 is joined to the front end face 57 of the metal shell 50. The front end portion 31 of ground electrode 30 is bent toward the inner face 33 side and forms a spark discharge gap between an electrode tip 91 bonded to the inner face 33 and an electrode tip 90 of the center electrode 20. For the sake of convenience, when referring to the side faces of the ground electrode 30, a direction perpendicular to the axis line P in a wide side face is referred to as a width Q direction of the ground electrode 30. (See FIG. 4). A direction perpendicular to the axis line P in a narrow side face is referred to as a thickness direction of the ground electrode 30.

As shown in FIGS. 2 and 3, the core material 35 embedded in the electrode base material 34 has a double structure, and is comprised of: an outer core 36 made of a metal containing Cu, Fe, Ag, Au or the like as an elemental substance, or an alloy containing Cu, Fe, Ag, Au or the like as a main component; and an center core 37 located inside the outer core 36 and made of a metal containing Ni or Fe as an elemental substance or an alloy containing Ni or Fe as a main component. As shown in FIGS. 2 to 5, the core material 35 is embedded in the electrode base material 34 so as to align with the axis line P of the ground electrode 30, extends like a flat plate shape so as to align with the plate-like ground electrode 30 and extends to a vicinity area where the electrode tip 91 of the front end portion 31 is bonded to.

As shown in FIG. 4, when the core material 35 is seen from the thickness direction of the ground electrode 30, the core material 35 is divided into two forks in the front end portion 31 and extends towards an edge 38 of the front end portion 31. An outline defined by projecting the core material 35 on the inner face 33 of the front end portion 31 of the ground electrode 30 is generally comprised of: two segments (a first segment and a second segment) extending along the axis line P; and a third segment connecting the first segment and the second segment at the edge 38 of the front end portion 31. The first segment and the second segment are a segment AB and a segment DE, respectively, extended generally in parallel to the axis line P (this direction corresponds to a "first direction" in the invention), and are equivalent to the outline of side edges of the core material 35 extending to the rear end portion 32 of the ground electrode 30 (not illustrated in FIG. 4). Further, the third segment is a segment BFGHE which connects the segments AB and DE at the edge 38 of the front end portion 31 of the ground electrode 30 in the width Q direction (this direction corresponds to a "second direction" in the invention). The segment AB, the segment DE and the segment BFGHE correspond to the "first segment", the "second segment" and the "third segment", respectively, in the invention.

The segment BFGHE constituting the outline of the core material 35 assumes a generally "M" shape in the embodiment. More particularly, points F, G and H on the segment BFGHE satisfy the following conditions. First, a point on the segment BFGHE located in the center with respect to the width Q direction is regarded as the point G. A point located at the segment AB side with respect to the point G and nearest to the edge 38 of the front end portion 31 is regarded as the point F. Similarly, a point located at the segment DE side with respect to the point G and nearest to the edge 38 of the front end portion 31 is regarded as the point H. At this time, the segment BFGHE assumes a shape in which the positions of the points F, H are nearest to the edge 38 of the front end portion 31 with respect to the point G in the axis line P direction. The points G, F and H are referred to as "a first part", "a second part" and "a third part", respectively, in the invention.

The electrode tip 91 bonded to the inner face 33 of the front end portion 31 of the ground electrode 30 assumes a columnar shape in the embodiment. One side perpendicular to an axis line of the electrode tip 91 is in contact with the inner face 33 of the ground electrode 30 as a bonding face and, with this state, welded to the front end portion 31 through resistance welding. On the inner face 33 of the ground electrode 30 in the embodiment, the positional relation between the contact face of the electrode tip 91 before bonding and the outline of the core material 35 defined by projecting the core material 35 onto the inner face 33 is specified as follows.

First, before bonding the ground electrode 30 and the electrode tip 91, the outline of a contact face (the bonding face) of the electrode tip 91, which is in contact with the inner face 33, is not in touch with the outline of the core material 35 defined by projecting the core material 35 onto the inner face 33. That is, the position of the core material 35 and that of the electrode tip 91 does not overlap each other in the thickness direction of the ground electrode 30. Next, a point on the outline of the bonding face of the electrode tip 91 bonded to the inner face 33 which is the furthest position away from the edge 38 in the axis line P direction is regarded as a point I. At this time, in the axis line P direction, the point I is located in a position at least either between the point G and the point F or between the point G and the point H. That is, a part of the outline (including the point I) of the bonding face of the electrode tip 91 is located in a valley of the "V" shaped segment FGH, which is constituted by the points F, G and H on the segment BFGHE. The point I corresponds to a "fourth part" in this invention.

The electrode tip 91 of the embodiment assumes a columnar shape and has an outer diameter of 2 mm or more. More particularly, the positional relation between such an electrode tip 91 and the core material 35 will be specified as follows. First, on the inner face 33, a point corresponding to a center axis of the bonding face of the electrode tip 91 is regarded as a location C, and a radius of the bonding face is regarded as R. In the axis line P direction, a distance between the point G and the location C is regarded as L1, the distance between the point F and the location C is regarded as L2 and the distance between the point H and the location C is regarded as L3. Further, in the width Q direction (i.e., upper side to lower side direction in FIG. 4), the distance between the point F and the location C is regarded as W2, the distance between the point H and the location C is regarded as W3. At this time, the positional relation between the electrode tip 91 and the core material 35 satisfy an expression of $R<L1$ and at least either expression of $W2>R$ or $W3>R$, and further satisfying at least either the expression of $L2<L1$ or $L3<L1$.

Thus, in the ground electrode 30, the core material 35 is divided into two forks in the front end portion 31 and extends toward the edge 38 so as to avoid an area in the thickness direction where the electrode tip 91 is disposed. With this construction, the core material 35 can be disposed nearest to the edge 38 of the front end portion 31, as well as closer to an outer circumference face of the ground electrode 30. As a result, the heat which the ground electrode 30 receives from the combustion chamber can promptly be conducted to the core material 35, thereby efficiently conducting the heat to the metal shell 50 through the core material 35. On the other hand, when extending the core material 35 to a position nearer to the edge 38 of the front end portion 31, the core material 35 is disposed so as to avoid the position of the electrode tip 91. As a result, the heat required for the resistance welding is unlikely to be drawn through the core material 35 when welding the electrode tip 91 to the front end portion 31 by the resistance welding, thereby preventing a poor bonding between the ground electrode 30 and the electrode tip 91. Of course, when the electrode tip 91 is bonded to the ground electrode 30 through laser welding instead of resistance welding, it is possible to avoid the poor bonding therebetween. However, since the electrode tip 91 according to this embodiment has the outer diameter of 2 mm or more and assumes the columnar shape, an area not in contact with the ground electrode 30 may remain in the central area of the bonding face when the laser welding is used for bonding such a large bonding face of the electrode tip 91 to the ground electrode 30 because the laser welding is performed to a peripheral edge of the bonding face. In the ground electrode 30 which receives the heat from an engine drives, the electrode tip 91 is likely to drop out due to the long-term use of the spark plug. Thus, the columnar electrode tip 91 having the outer diameter of 2 mm or more is preferably bonded with the entire bonding face to the ground electrode 30 by the resistance welding as mentioned above.

To explain the positional relation between the electrode tip 91 and the core material 35, the bonding face in the invention means a contact face being in contact with the inner face 33 of the ground electrode 30 at the time of the resistance welding of the electrode tip. Since the contact face after the resistance welding is melt with the electrode base material 34 of the ground electrode 30, it is difficult to identify the outline of the electrode tip. In this case, in order to identify the outline of the electrode tip 91, an area defined by a virtual line which extends from the outer circumference face of the electrode tip 91 and is perpendicular to the inner face 33 is deemed to be a bonding face when, for example, the electrode tip 91 assumes a columnar shape according to the embodiment and has a bonding face perpendicular to the axis line of the electrode tip 91. Similarly, when the electrode tip 91 assumes a prismatic shape or a disc shape, an area defined by a virtual line perpendicular to the inner face 33 and extending from the outer circumference face, which forms the outline of the contact face, is deemed to be the bonding face.

The virtual line deemed to be the outline of the contact face should not overlap with the outline of the core material 35 on the inner face 33. In this case, the outline of the core material 35 may be identified by, for example, an X-ray of the inner face 33 of the ground electrode 30 or the cross-section of the ground electrode 30 in the thickness direction. Although a part of melting portion of the electrode tip 91 resulting from the welding may overlap with the thus-identified outline of the core material 35, a sufficient effect can be obtained as long as the virtual line deemed to be the outline the bonding face of the electrode tip 91 does not overlap with (in a noncontact state) the outline of the core material 35, in the light of the prevention of a deterioration in the bonding strength caused by the core material 35 that is likely to draw the heat produced during the resistance welding.

Figure 6:
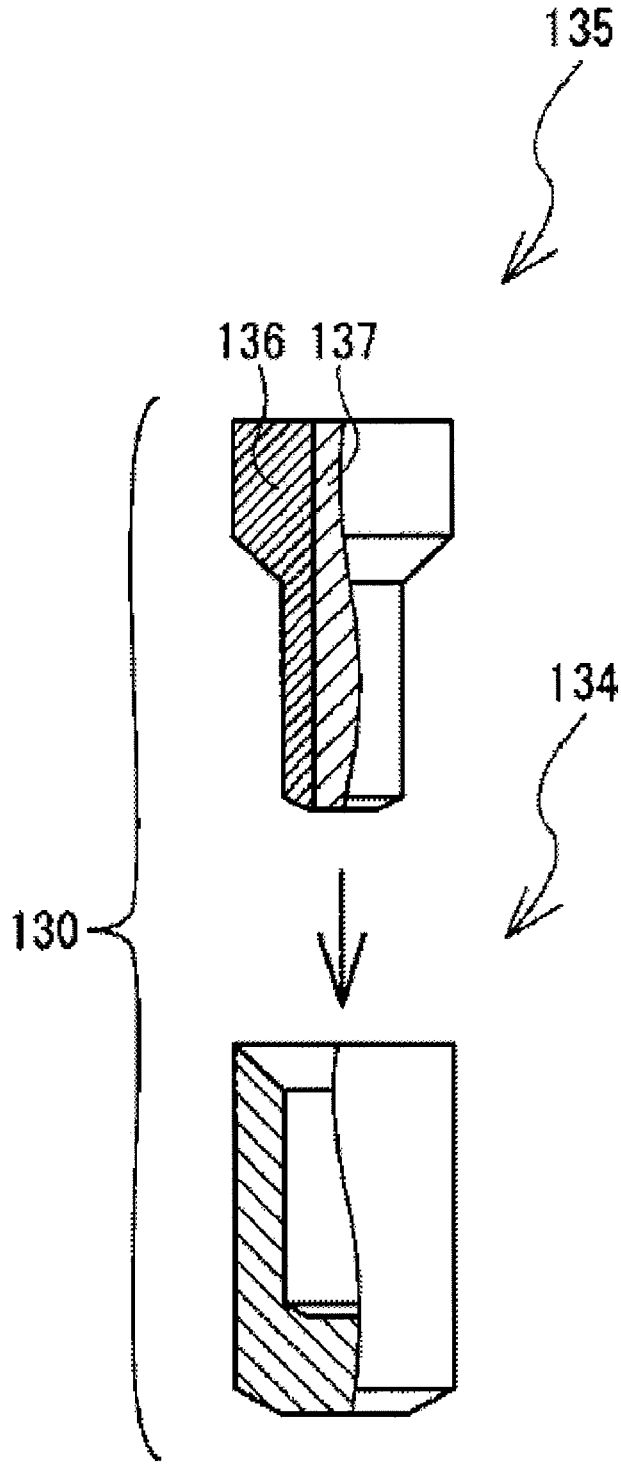
FIG. 6 is a partial sectional view showing a composition of a ground electrode base material 130 which serves as a base for the ground electrode 30.
Figure 7:
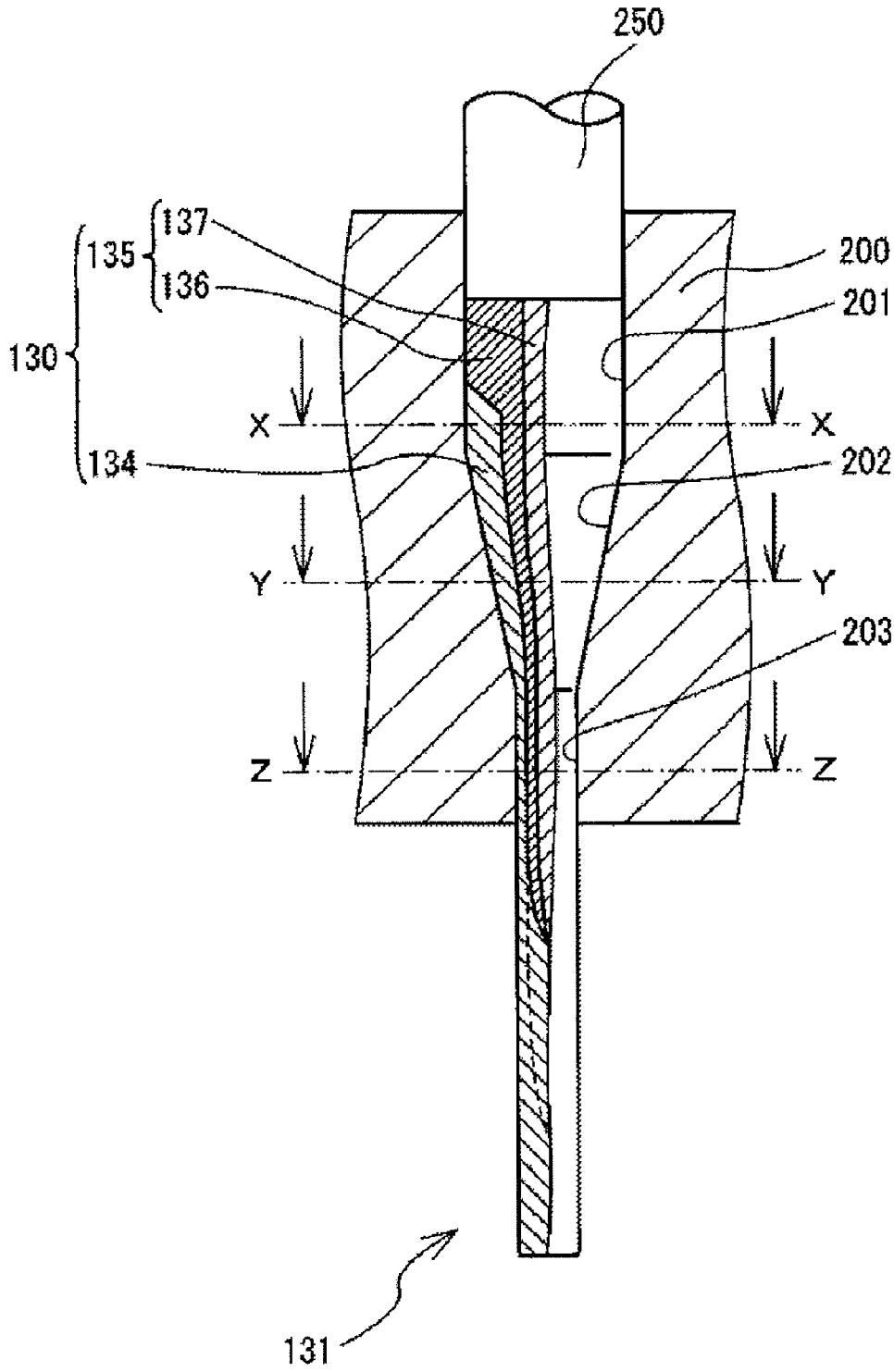
FIG. 7 is a partial sectional view showing an extrusion molding process of the ground electrode base material 130 which is performed using a dice 200.
Figure 8:
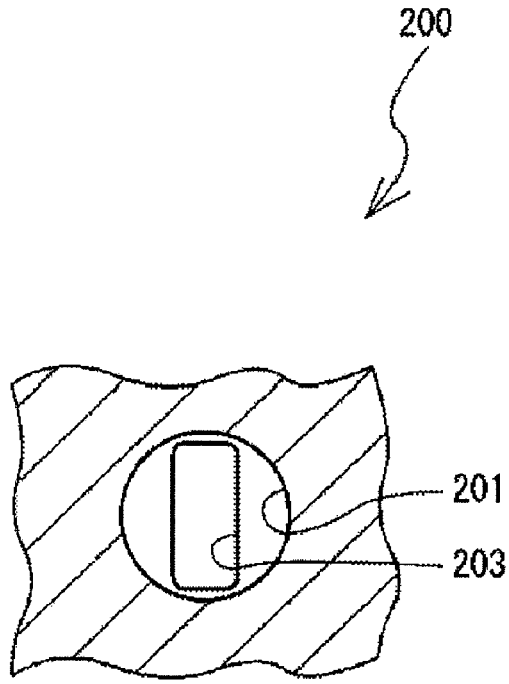
FIG. 8 is a sectional view of the dice 200 seen from the arrow direction in a single dotted-line X-X of FIG. 7.
Figure 9:
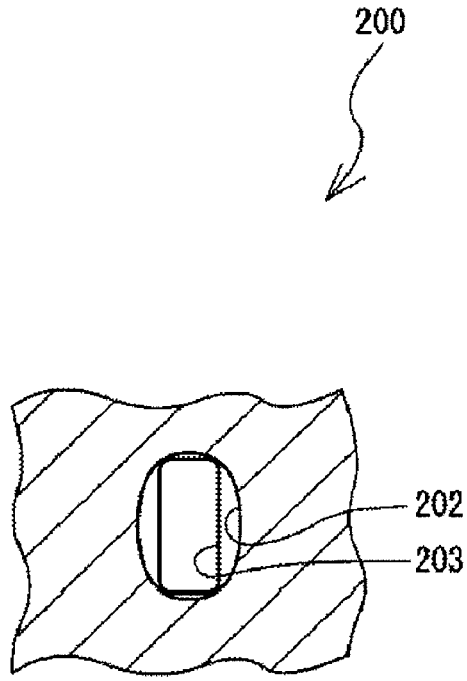
FIG. 9 is a sectional view of the dice 200 seen from the arrow direction in a single dotted-line Y-Y of FIG. 7.
Figure 10:
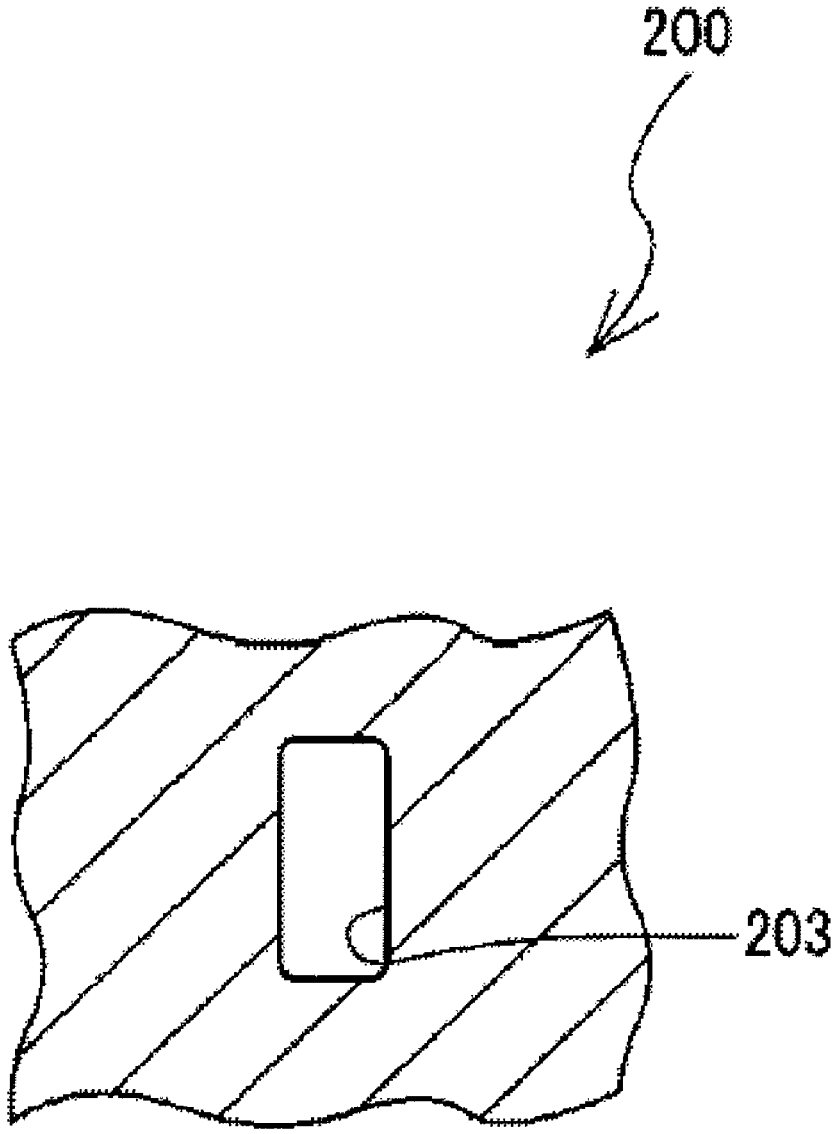
FIG. 10 is a sectional view of the dice 200 seen from the arrow direction in a single dotted-line Z-Z of FIG. 7.
Figure 11:
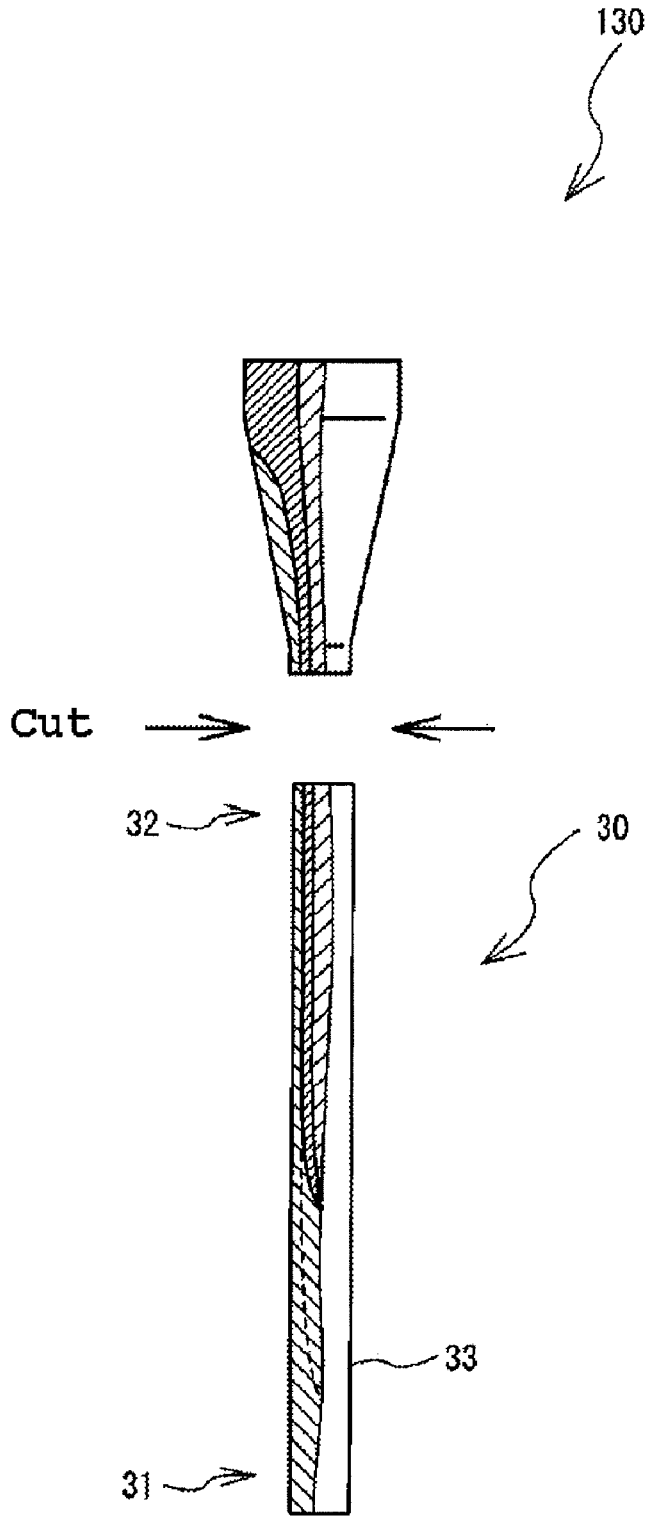
FIG. 11 is a diagram showing a way how to obtain the ground electrode 30 by cutting the ground electrode base material 130 formed by an extrusion molding.

Next, a method for manufacturing the ground electrode 30 having the two-fork shaped core material 35 in the front end portion 31 will be described with reference to FIGS. 6 to 11. FIG. 6 is a partial sectional view showing a composition of a ground electrode base material 130 which serves as a base for the ground electrode 30. FIG. 7 is a partial sectional view showing an extrusion molding process of the ground electrode base material 130 which is performed using a dice 200. FIG. 8 is a sectional view of the forming die 200 seen from an arrow direction in a single dotted-line X-X of FIG. 7. FIG. 9 is a sectional view of the forming die 200 seen from the arrow direction in a single dotted-line Y-Y of FIG. 7. FIG. 10 is a sectional view of the forming die 200 seen from the arrow direction in a single dotted-line Z-Z of FIG. 7. FIG. 11 is a diagram showing a way how to obtain the ground electrode 30 by cutting the ground electrode base material 130 formed by an extrusion molding.

As shown in FIG. 6, in the manufacture process of the ground electrode 30, a cylindrical nickel alloy material serving as a base for the electrode base material 34 is formed into a bottomed cylindrical shape through a cold forging process to thereby form an electrode base material 134. A columnar center core base material 137 serving as a base for the center core 37 is inserted in a cylindrical outer core base material 136 serving as a base for the outer core 36 so as to form an integrated body. The thus-produced integrated body is formed into a columnar core base material 135, serving as a base for the core material 35, with a flange portion so as to engage with a concave portion of the electrode base material 134 through the cold forging process or a cutting process. The core base material 135 is inserted in and fitted to the concave portion of the electrode base material 134 to thereby form the ground electrode base material 130.

Next, the ground electrode base material 130 is inserted in an aperture formed in a die 200 from the cylindrical bottom side of the electrode base material 134 to perform an extrusion molding using a punch 250. As shown in FIG. 8, the die 200 has an inner circumference face 201 at the side where the ground electrode base material 130 is inserted, and the inner circumference face 201 assumes a circular sectional shape so as to match with the outer circumference of the electrode base material 134. As shown in FIG. 10, an inner circumference face 203 at the side from which the ground electrode base material 130 is extracted is formed into a generally rectangular shape (refer to FIG. 3) so as to match with the sectional shape of the ground electrode 30. Further, as shown in FIG. 9, an inner circumference face 202 connecting the inner circumference face 201 and the inner circumference face 203 is formed into a tapered shape. As shown in FIG. 7, the ground electrode base material 130 is inserted in the die 200 and subjected to the extrusion molding using the punch 250. Then, the electrode base material 130 is extended in the axis line P direction to thereby form a columnar body which the core base material 135 and the electrode base material 134 are adjacently joined.

The ground electrode base material 130 assumes a circular shape in the sectional view perpendicular to the axis line P. The ground electrode base material 130 is crushed flatly so that the cross-sectional shape thereof matches to the shape of the inner circumference face 203 of the die 200. Thus, in the sectional view of the ground electrode 30 shown in FIG. 3, a portion corresponding to the center with respect to the width Q direction is compressed the most in the thickness direction. Since a material forming a bottom portion of the bottomed cylindrical electrode base material 134 occupies the most of the center area in the ground electrode 30 in the width Q direction after forming the ground electrode 30, the core base material 135 in the center area with respect to the width Q direction is prevented from being extruded compared to the case of both ends of the core base material 135 with respect to the width Q direction. For this reason, in the front end portion 131 of the ground electrode base material 130, the core base material 135 is divided into two forks towards the front direction where the ground electrode base material 130 is extruded when the core base material 135 is projected onto the inner face 33 in the thickness direction.

The rear end side of the thus-extrusion molded ground electrode base material 130 is cut after being extended to a predetermined length to thereby complete the ground electrode 30. The rear end portion 32 at the rear end side of the extrusion direction (the side to be cut) is joined to the front end face 57 of the metal shell 50 produced through a separate process. At this time, the ground electrode 30 is joined so that a side thereof in the thickness direction serves as the inner face 33 and faces the central axis of the metal shell 50. Then, the electrode tip 91 is bonded to the inner face 33 of the front end portion 31 through the resistance welding. Since the core material 35 is formed into the two-fork shape as mentioned above, and the core material 35 and the electrode tip 91 do not overlap each other in the thickness direction of the ground electrode 30, the heat produced during the resistance welding is unlikely to be drawn by the core material 35, thereby preventing the deterioration in the bonding strength. Further, the insulator 10 produced through a separate process and integrally holding the center electrode 20 and the terminal metal fitting 40 is inserted in the metal shell 50 and subjected to caulking. The ground electrode 30 has one face in the thickness direction which serves as the inner face 33 and is bent so that the inner face 33 faces an inner side and is opposed to the front end portion 22 of the center electrode 20. As a result, the spark plug 100 having a spark discharge gap between the electrode tip 91 of the ground electrode 30 and the electrode tip 90 of the center electrode 20 is completed.

The present invention is not particularly limited to the embodiments described above but may be changed or modified in various ways. For example, although the electrode tip 91 assumes a columnar shape in the embodiment, it may assume a square pillar, a pyramid or a cone shape, as well as a disk or a rectangular plate shape. Further, the electrode tip 90 is provided on the center electrode 20, and the electrode tip 91 is provided on the ground electrode 30 in the embodiment. However, the electrode tip may be provided only on either of the sides—i.e., it is not necessarily for the electrode tips 90, 91 to be provided on both the center electrode 20 and ground electrode 30, respectively, as in the above embodiment.

Figure 12:
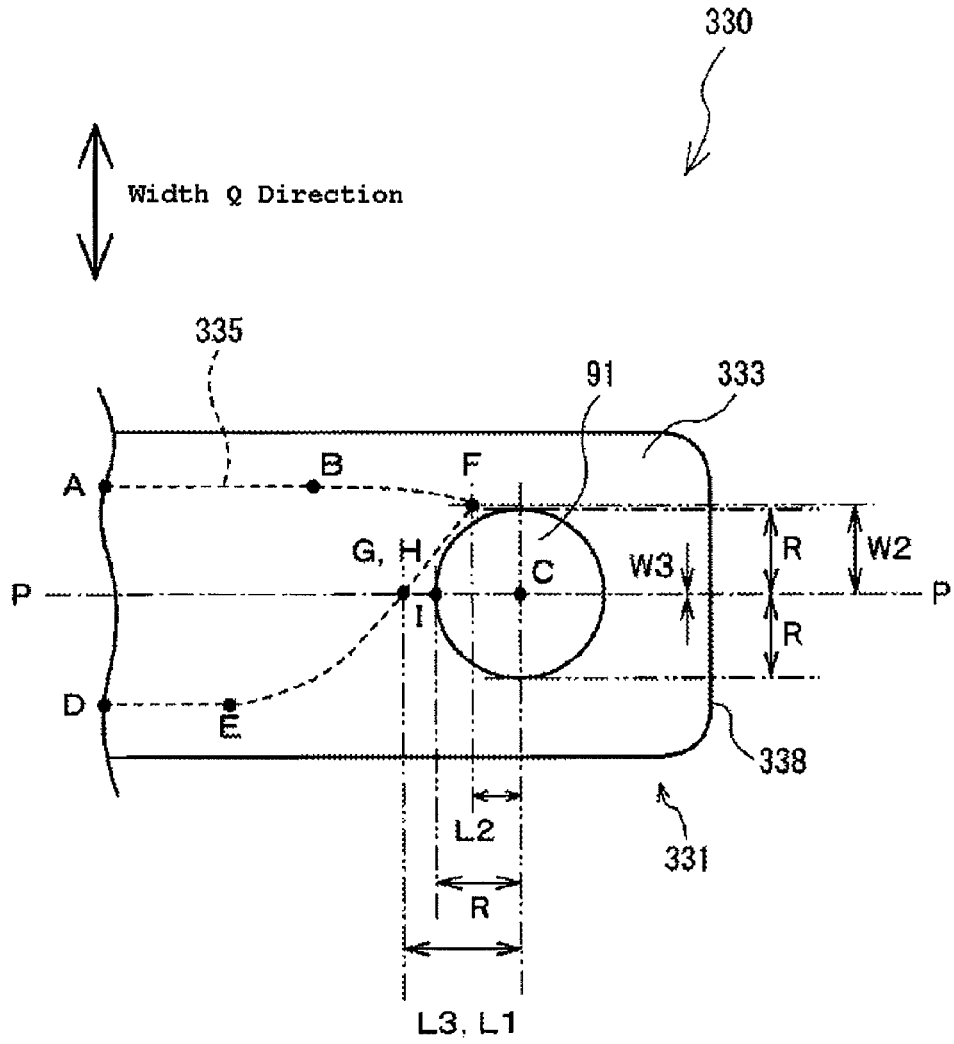
FIG. 12 is a diagram showing a positional relation between the electrode tip 91 and a core material 335 whose outline is defined by projecting the core material 335 onto an inner face 333 of a ground electrode 330 in the thickness direction according to the modification.

Furthermore, in the embodiment, although the outline of the core material 35 defined by projecting the core material 35 onto the inner face 33 of the front end portion 31 of the ground electrode 30 in the thickness direction assumes a two-fork shape and extends towards the edge 38, the outline of the core material 35 does not necessarily assume the two-fork shape. For example, in a ground electrode 330 as shown in FIG. 12, an outline of a core material 335 defined by projecting the core material 335 onto an inner face 333 in the thickness direction (i.e., front page to back page direction where FIG. 12 is shown) is comprised of: a segment AB and a segment DE which are, as similar to the embodiment, deemed to extend generally in parallel to the axis line P; and a segment BFGHE which connects the segment AB and the segment DE at an edge 338 of a front end portion 331. A point on the segment BFGHE located in the center with respect to the width Q direction and perpendicular to the axis line P is regarded as a point G. A point on the segment BFGHE located at the segment AB side with respect to the point G and nearest to the edge 338 of the front end portion 331 is regarded as a point F. Further, a point on the segment BFGHE located at the segment DE side with respect to the point G and nearest to the edge 338 of the front end portion 331 is regarded as a point H. At this time, while the position of the point F on the segment BFGHE is nearer to the edge 338 than that of the point G in the axis line P direction, the position of the point H may be the same as that of the point G or away from the point G with respect to the edge 338. That is, the segment BFGHE which constitutes the outline of the core material 335 may assume a shape which protrudes towards the edge 338 on either the segment AB side or the segment DE side from the center with respect to the width Q direction.

Similar to the embodiment, on the outline of the bonding face of the electrode tip 91 defined by projecting the bonding face onto the inner face 333 (or a virtual outline regarded as the outline of the bonding face), a point I located in the furthest position away from the edge 338 in the axis line P direction is preferably between the point G and the point F, and the outline (or a virtual outline regarded as the outline of the bonding face) of the bonding face of the electrode tip 91 preferably does not overlap (noncontact state) with the outline of the core material 335 in the thickness direction of the ground electrode 30. More particularly, the following conditions are preferably satisfied. In the axis line P direction, a distance L1 between the point G and a location C of the center axis of the electrode tip 91 is longer than a radius R of the bonding face of the electrode tip 91, a distance L2 between the point F and the location C is shorter than the distant L1 and a distant W2 between the location C and the point F is longer than the radius R in the width Q direction. In this way, the outline of the core material 335 extends towards the edge 338 on the inner face 333 of the front end portion 331 of the ground electrode 330, while avoiding overlapping with the outline (or a virtual outline regarded as the outline of the bonding face) of the bonding face of the electrode tip 91. Thus, heat can be successfully conducted from the front end portion 331 of the ground electrode 330, thereby preventing the deterioration in the bonding strength of the electrode tip 91.

However, the above description will not limit the state where the outline (or a virtual outline regarded as the outline of the bonding face) of the bonding face of the electrode tip 91 defined by projecting the bonding face onto the inner face 33 and the outline of the core material 35 are not in contact with each other. As in the embodiment, even if the outline of the electrode tip 91 overlaps with that of the core material 35 in the thickness direction, the proportion of the core material 35 occupying in the outline of the electrode tip 91 can be lowered by way of forming at least either the point F or the point H on the outline of the core material 35 defined by projecting the core material 35 onto the inner face 33 so as to extend towards the front end side of the ground electrode 30 with respect to the point G. That is, even in such a composition, the heat generated at the time of the resistance welding is unlikely to be drawn by the core material 35, thereby preventing the deterioration in the bonding strength.

The invention claimed is:

1. A spark plug, comprising:

a center electrode;

an insulator having an axial bore that extends along an axial direction of the center electrode and that accommodates the center electrode therein;

a metal shell surrounding the insulator in a radial direction so as to hold the insulator therein; and a ground electrode having one end bonded to the metal shell and a free end bent so that a side face of the ground electrode is located opposed to the center electrode, said ground electrode having a core material which extends through said ground electrode from one end of said ground electrode toward the free end of the ground electrode along a first direction, said core material defining a predetermined core profile outline when projected onto said side face, said core profile outline having a first segment, a second segment and a third segment, said first and second segments of said core profile each extending in said first direction and defining the lateral edges of said core material, and said third segment connecting said first segment to said second segment and generally defining an end of said core material, said third segment of said core profile outline having a first point thereon, said first point being disposed midway between the lateral sides of said ground electrode, wherein at least one side of said core profile outline extends toward said free end beyond said first point.

2. A spark plug according to claim 1, wherein an electrode tip having a bonding face is bonded to the side face of the ground electrode with said bonding face of said electrode disposed against said ground electrode.

3. A spark plug according to claim 2, wherein the electrode tip is bonded to the side face of the ground electrode through resistance welding, wherein said core profile outline has a second point on said first segment and a third point on said second segment, and wherein, the bonding face of the electrode tip defines an outline when projected onto the side face of the ground electrode, the outline of the bonding face of the electrode tip having a fourth point located thereon, said fourth point being in a furthest position away from the edge of the free end of the ground electrode and being disposed between the first point located on the outline of the core material and at least either the second point or the third point.

4. A spark plug according to claim 3, wherein, when the outline of the core material and that of the bonding face of the electrode tip bonded to the side face are projected, respectively, onto the side face of the ground electrode, the outline of the bonding face of the electrode tip and that of the core material are kept in a noncontact state.

5. A spark plug according to claim 3, comprising the columnar shape electrode tip with an outer diameter of 2 mm or more, wherein, the outline of the core material and that of the bonding face of the electrode tip bonded to the side face, defined by projecting the core material and the bonding face, respectively, onto the side face of the other end of the ground electrode, at least either a representation of W2>R or W3>R is satisfied, where location C is a position of the central axis of the electrode tip, R is a radius of the electrode tip, W2 is a distance between the position of a second point and the location C, and W3 is a distance between the position of a third point and the location C.

6. A spark plug according to claim 3, comprising the columnar shape electrode tip with an outer diameter of 2 mm or more, wherein, the outline of the core material and that of the bonding face of the electrode tip bonded to the side face defined by projecting the core material and the bond face, respectively, onto the side face of the ground electrode, and wherein at least either a representation of L2<L1 or L3<L1 is satisfied as is R<L1, where C is a position of the central axis of the electrode tip, R is a radius of the electrode tip, LI is a distance between the position of first point and the location C in the first direction, L2 is a distance between the position of second point and the location C in the first direction, and LC is a distance between the position of the third point and the location C in the first direction.

* * * * *